US010500596B2

(12) United States Patent
Lin et al.

(10) Patent No.: US 10,500,596 B2
(45) Date of Patent: Dec. 10, 2019

(54) COMBINATION SHOWERHEAD WITH PUSH BUTTON SWITCHING

(71) Applicants: XIAMEN SOLEX HIGH-TECH INDUSTRIES CO., LTD., Xiamen, Fujian (CN); Huasong Zhou, Fujian (CN)

(72) Inventors: Fengde Lin, Fujian (CN); Mingfu Zhang, Fujian (CN); Wenxing Chen, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 188 days.

(21) Appl. No.: 15/341,588

(22) Filed: Nov. 2, 2016

(65) Prior Publication Data

US 2017/0165684 A1 Jun. 15, 2017

(30) Foreign Application Priority Data

Dec. 11, 2015 (CN) ..... 2015 1 0922153

(51) Int. Cl.

*B05B 1/18* (2006.01)
*E03C 1/04* (2006.01)
*B05B 1/16* (2006.01)

(52) U.S. Cl.

CPC ..... *B05B 1/18* (2013.01); *E03C 1/0409* (2013.01); *B05B 1/1636* (2013.01)

(58) Field of Classification Search

CPC ..... B05B 1/1627; B05B 1/18; B05B 12/002; B05B 15/061; B05B 1/1636; B05B 1/185;
(Continued)

(56) References Cited

U.S. PATENT DOCUMENTS 7,043,776 B1 * 5/2006 Wu ..... E03C 1/0408 4/601
8,066,204 B2 * 11/2011 Petrovic ..... B05B 1/1609 239/443

(Continued)

FOREIGN PATENT DOCUMENTS

CN 103521369 A 1/2014

*Primary Examiner* — Arthur O. Hall
*Assistant Examiner* — Steven M Cernoch
(74) *Attorney, Agent, or Firm* — Rabin & Berdo, P.C.

(57) ABSTRACT

A combination showerhead with push button switching comprises a fixing holder, two showerheads and a switching mechanism. The first showerhead is mounted to the fixing holder; the fixing holder comprises an inlet passage connected to a supporting arm and two diversion passages connected to two showerheads respectively. The switching mechanism comprises a diversion plate, a valve core, a push button and an elastomer. The diversion plate is connected to the fixing holder movably and cooperates with the inlet and diversion passages to switch waterways by rotating a predetermined angle. The valve core is slidably connected to the fixing holder and connected to the diversion plate to drive the diversion plate to rotate by back-and-forth sliding. The push button is movably connected to the fixing holder and connected to the valve core to drive the valve core to slide by a user's pushing.

8 Claims, 12 Drawing Sheets

(58) Field of Classification Search
CPC ..... E03C 1/025; E03C 1/0408; E03C 1/0409; E03C 2201/30; E03C 1/06
See application file for complete search history.

(56) References Cited

U.S. PATENT DOCUMENTS

| | | | | |
|---|---|---|---|---|
| 8,695,897 | B2 * | 4/2014 | Engel | B05B 1/185 239/393 |
| 9,707,574 | B2 * | 7/2017 | Soetaert | B05B 1/18 |
| 9,849,471 | B2 * | 12/2017 | Lin | B05B 1/1627 |
| 10,060,105 | B2 * | 8/2018 | Lin | B05B 1/18 |
| 2006/0138253 | A1 * | 6/2006 | Petrovic | B05B 1/1609 239/446 |
| 2007/0158460 | A1 * | 7/2007 | Lev | B05B 1/1672 239/132.1 |
| 2008/0169362 | A1 * | 7/2008 | Kwan | E03C 1/06 239/442 |
| 2009/0276953 | A1 * | 11/2009 | Hsu | E03C 1/0408 4/601 |
| 2009/0289129 | A1 * | 11/2009 | Qiu | B05B 1/1618 239/550 |
| 2012/0151669 | A1 * | 6/2012 | Wilson | E03C 1/066 4/615 |
| 2015/0041562 | A1 * | 2/2015 | Peel | B05B 1/1654 239/447 |
| 2015/0090812 | A1 * | 4/2015 | Wu | E03C 1/0409 239/446 |
| 2015/0115064 | A1 * | 4/2015 | Wu | B05B 1/185 239/443 |
| 2015/0360243 | A1 * | 12/2015 | Soetaert | B05B 1/18 4/615 |

* cited by examiner

COMBINATION SHOWERHEAD WITH PUSH BUTTON SWITCHING

FIELD OF THE INVENTION

The present invention relates to a combination showerhead, and especially to a combination showerhead with push button switching.

BACKGROUND OF THE INVENTION

The existing combination showerhead, as Chinese patent No. 103521369A disclosed, is a shower system comprising a top-spray showerhead with at least two spray types and a handle showerhead, and the top-spray showerhead is disposed with an inlet passage for water supply and first diversion passages corresponding to spray types; the top-spray showerhead is disposed with a second diversion passage connected to the handle showerhead by a hose; a switching mechanism disposed on the top-spray showerhead is capable of switching waterway by cooperating with the inlet, first passages and second passages, thereby any of the diversion passage could be selected to connect with the inlet. However, the structure is not compact enough and needs further improvement.

SUMMARY OF THE INVENTION

The objective of the present invention is to provide a combination showerhead with push button switching, which overcome the disadvantages of the existing technology.

The technical proposal of the present invention is:

A combination showerhead with push button switching comprising: a fixing holder (10) mounted to a supporting arm, a first showerhead (20) mounted to the fixing holder, a second showerhead (30) and a switching mechanism (40). The fixing holder (10) comprises an inlet passage (11) connected to the supporting arm and at least two diversion passages (12), of which one is connected to the second showerhead (30) and another is connected to the first showerhead (20);

wherein the switching mechanism (40) comprises:

a diversion plate (41), which is capable of being movably connected to the fixing holder (10), and cooperating with the inlet passage (11) and the diversion passages (12) to switch waterways by rotating a predetermined angle;

a valve core (42), which is capable of being slidably connected to the fixing holder (10) and connected to the diversion plate (41) in a transmission way to drive the diversion plate (41) to rotate the predetermined angle by back-and-forth sliding;

a push button (43), which is capable of being movably connected to the fixing holder (10) and connected to the valve core (42) in a transmission way to drive the valve core (42) to slide by a user's pushing; and an elastomer (44), which is capable of resetting the valve core (42).

In another preferred embodiment, the switching mechanism (40) further comprises a shaft (45) capable of being fixed to the diversion plate (41). The end of the valve core (42), the end of the shaft (45), and the fixing holder (10) are disposed with ratchets; the diversion plate (41) is rotatable and movable along a rotation axis relative to the fixing holder (10). The elastomer (44) abuts against and is between the diversion plate (41) and the fixing holder (10); the ratchets disposed on the end of the valve core (42), the shaft (45) and the fixing holder (10) work in co-ordination to form a pencil lead mechanism, and back-and-forth sliding of the valve core (42) drives the shaft (45) along with diversion plate (41) to rotate the predetermined angle.

In another preferred embodiment, the push button (43) is slidably connected to the fixing holder (10), the push button (43) comprises a fixing plate (431), and a forking part (432) is formed on the end of the fixing plate (431), the valve core (42) is concavely disposed with a connecting groove (421); the forking part (432) inserts into the connecting groove (421) and the push button (43) drives the valve core (42) to slide.

In another preferred embodiment, the back of the fixing holder (10) is convexly disposed with an assembly portion (13) and the switching mechanism (40) is disposed inside the assembly portion (13), the push button (43) is movably connected to the assembly portion (13) with at least a part of the push button located outside of the assembly portion for pushing.

In another preferred embodiment, the second showerhead (30) is a handle showerhead; the outlet of the diversion passages (12) connected to the second showerhead (30) is disposed on the sidewall of the assembly portion (13), and the handle showerhead connects with a corresponding outlet through a flexible hose (50), and a front lower part of the fixing holder (10) is disposed with a connecting portion (14) for handle showerhead positioning.

In another preferred embodiment, the second showerhead (30) is a fixed showerhead fixed on the front lower part of the fixing holder (10).

In another preferred embodiment, the fixing holder (10) has a common portion (15) and two forking portions (16) extend from the common portion (15), the first showerhead (20) is rotatably connected between the two forking portions (16); a hose piece (21) disposed along the rotation axis of the first showerhead (20) is connected to the first showerhead (20), and a part of other diversion passages (12) is disposed along the hose piece (21).

In another preferred embodiment, the assembly portion (13) is disposed on the back of the common portion (15).

In another preferred embodiment, the first showerhead (20) is capable of being rotatably connected to the fixing holder (10), and a damping mechanism (60) is disposed between the fixing holder (10) and the first showerhead (20).

In another preferred embodiment, the damping mechanism (60) comprises a locating holder (61), a turning block (62) and a cam (63), at least two dangling pieces (64) disposed separately in a circumferential direction on the locating holder (61) form a rotary sleeve-like structure with at least part of the inner wall being of changing radii, the cam (63) is disposed in the rotary sleeve to match the changing radii, the turning block (62) sleeves the rotary sleeve, and friction force of the dangling pieces (64) and the turning block (62) changes with rotation of the cam (63) relative to the changing radii, and thereby the damping changes.

In another preferred embodiment, the fixing holder (10) has a common portion (15) and the first showerhead (20) is rotatably connected to the common portion (15); at least a hose piece (21) disposed along the rotation axis of the first showerhead (20) is connected to the first showerhead (20), and part of other diversion passages (12) is disposed along the hose piece (21).

Compared to the existing technology, the present invention has advantages as follows:

1. The switching mechanism is disposed on a fixing holder; the first showerhead could be a new design or an existing one; the push button drives the valve core to slide and the valve core drives the diversion plate to rotate, thereby the switching is realized. The switching with push button driving is novel and convenient for one-handed operation, moreover, the position of push button and valve core could be disposed according to the requirement of the fixing holder, which is of reasonable layout and compact structure.

2. All of the valve core, shaft and fixing holder are disposed with ratchets, the ratchets working in co-ordination to form a pencil lead mechanism. Pushing of the valve core drives the shaft to slide upward and rotate positively in a ½ predetermined angle, and a reset of the valve core drives the shaft to slide downward and rotate positively in a ½ predetermined angle again. Thereby, back-and-forth sliding of the valve core drives the shaft along with the diversion plate to rotate a predetermined angle, which is of reasonable layout, simple structure, dependable switching stability and easy operation.

3. The push button is slidably connected to the fixing holder, the push button comprises a fixing plate and a forking part is formed on the end of the fixing plate, the valve core is concavely disposed with a connecting groove, and the forking part inserts into the connecting groove, which facilitates easy assembly with simple and compact structure.

4. A back of the fixing holder is convexly disposed with an assembly portion and the switching mechanism is disposed inside the assembly portion, and the push button is movably connected to the assembly portion with at least part of the push button located outside the assembly portion for pushing, which is of reasonable layout, compact structure, good-looking appearance and easy operation.

5. A connecting portion for handle showerhead positioning is disposed on the front lower part of the fixing holder, which facilitates, by users, taking down or laying up with a good-looking appearance.

6. The fixing holder has a common portion and forking portions, and the first showerhead is rotatably connected between the two forking portions; since the first showerhead is rotatable, users can adjust the angle of water flowing according to needs, which is convenient.

7. A damping mechanism is disposed between the fixing holder and the first showerhead so that the first showerhead can be positioned at a certain angle.

8. With rotation of the cam relative to the changing radii part, friction force of the dangling pieces and the turning block changes and thereby the damping changes, which is of simple and compact structure and easy to use.

BRIEF DESCRIPTION OF THE DRAWINGS

The present invention will be further described with the drawings and the embodiments.

DETAILED DESCRIPTION OF THE EMBODIMENTS

Figure 1:
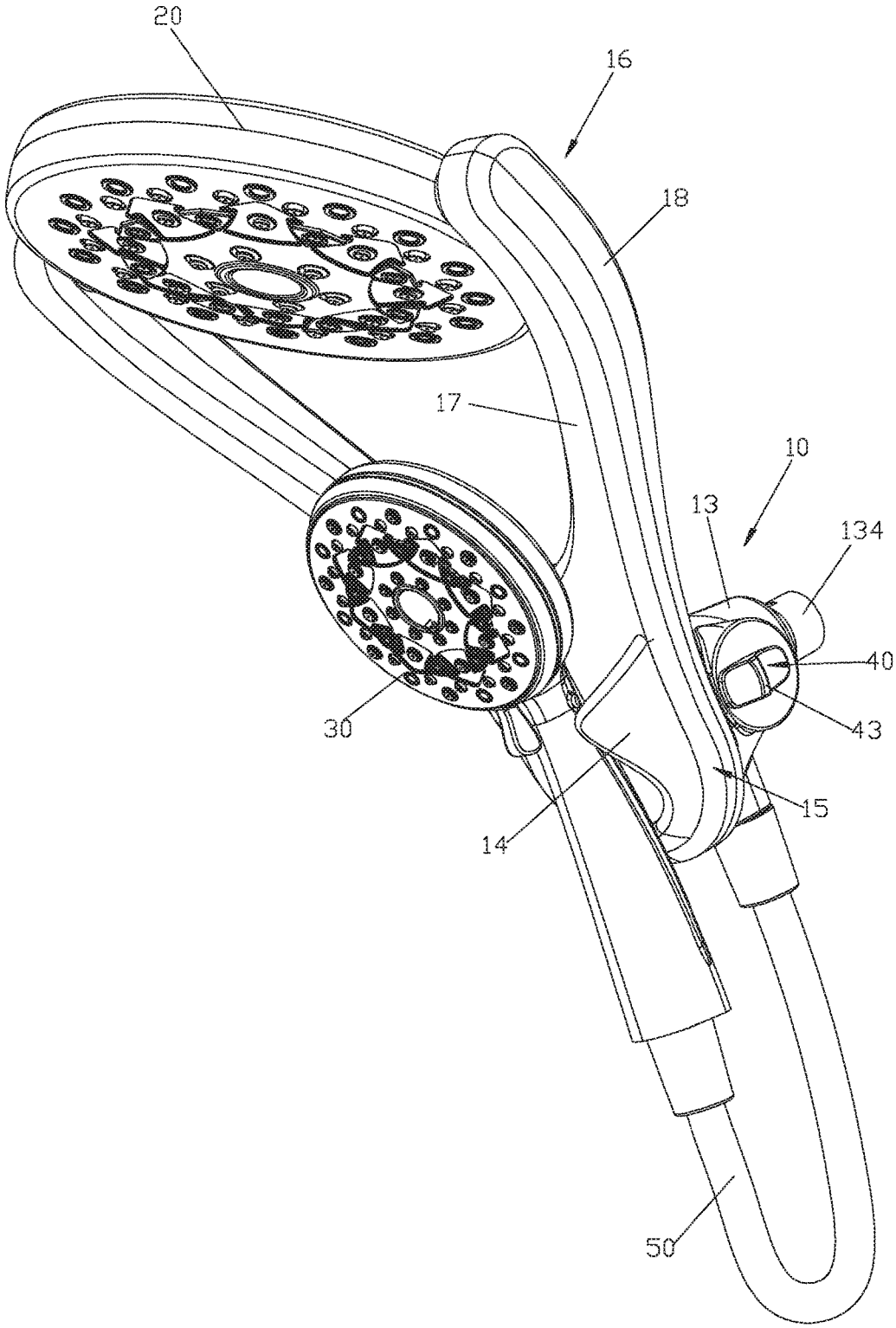
FIG. 1 illustrates a perspective schematic diagram of the combination showerhead of a preferred embodiment.
Figures 2, 3:
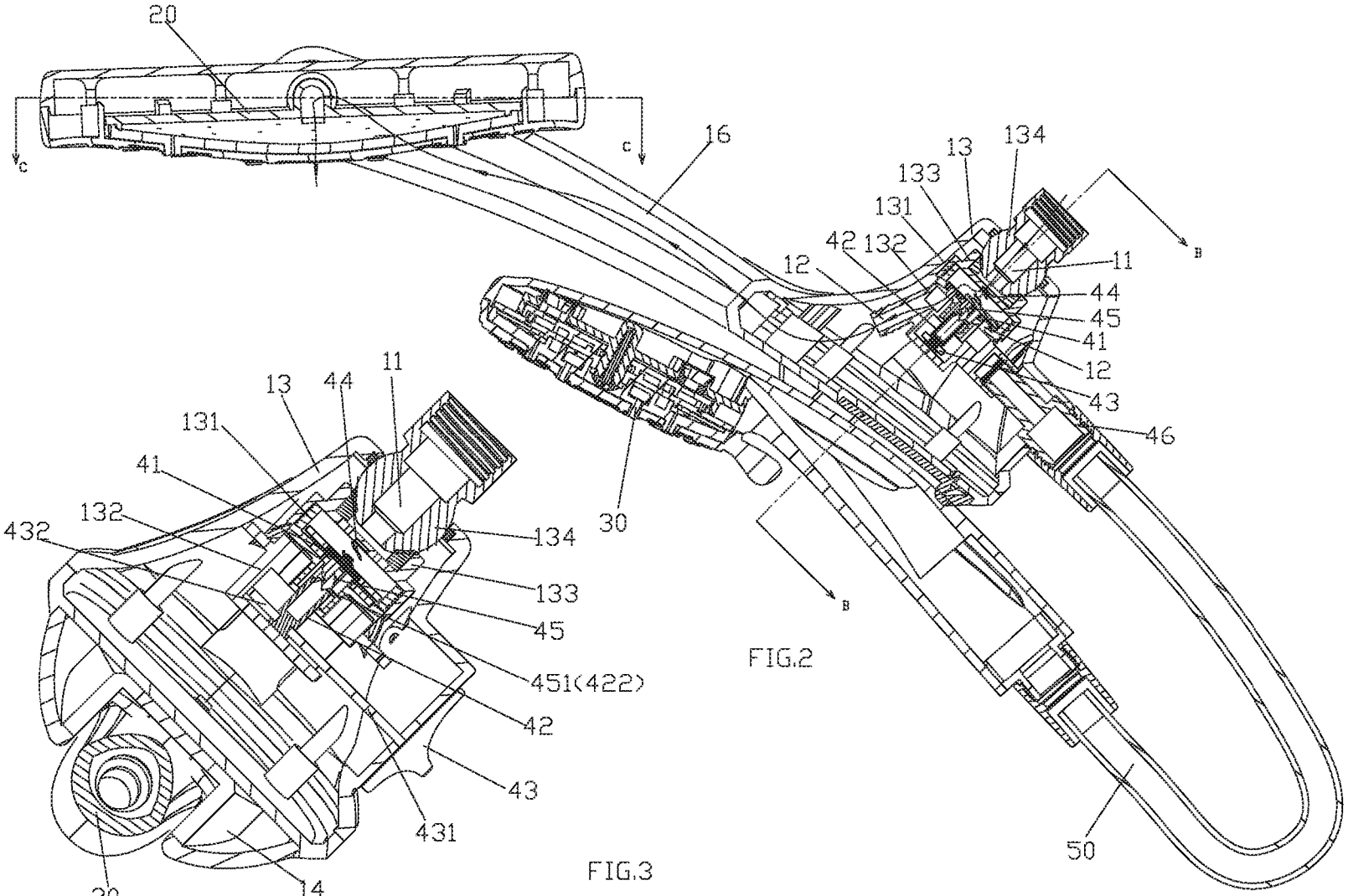
FIG. 2 illustrates a cross-sectional schematic diagram of the combination showerhead of a preferred embodiment under a condition that water flows from the first showerhead.
FIG. 3 illustrates a B-B cross-sectional schematic diagram of the combination showerhead of FIG. 2.
Figure 4:
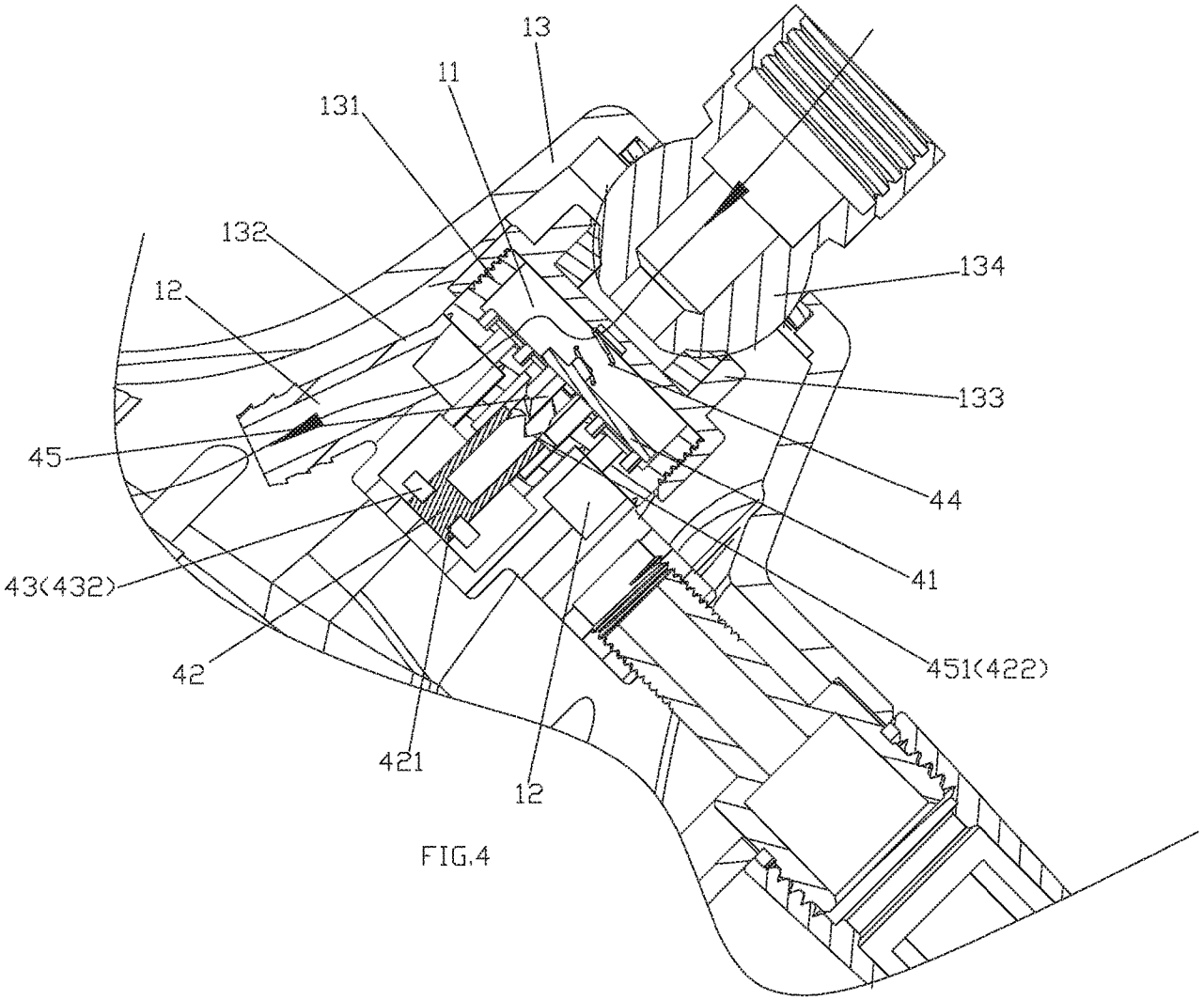
FIG. 4 illustrates a local enlarged schematic diagram of the combination showerhead of FIG. 2.

A combination showerhead with push button switching, referring to FIG. 1 to FIG. 12, comprises fixing holder 10, first showerhead 20, second showerhead 30 and switching mechanism 40. Fixing holder 10 could be mounted to a supporting arm which could be a water supply pipe fixed on the wall and the connection could be a permanent connection or a universal connection coordinate with spherical structure. The first showerhead 20 could be a top spray showerhead or a head showerhead mounted to fixing holder 10. The first showerhead 10 could have one or more functions for different water spray types. Fixing holder 10 comprises inlet passage 11 connected to the supporting arm and at least two diversion passages 12.

One diversion passage 12 is connected to second showerhead 30;

Others are connected to first showerhead 20, wherein:

If the first showerhead 20 has one water spray function, the number of diversion passages 12 is 2.

Figure 5:
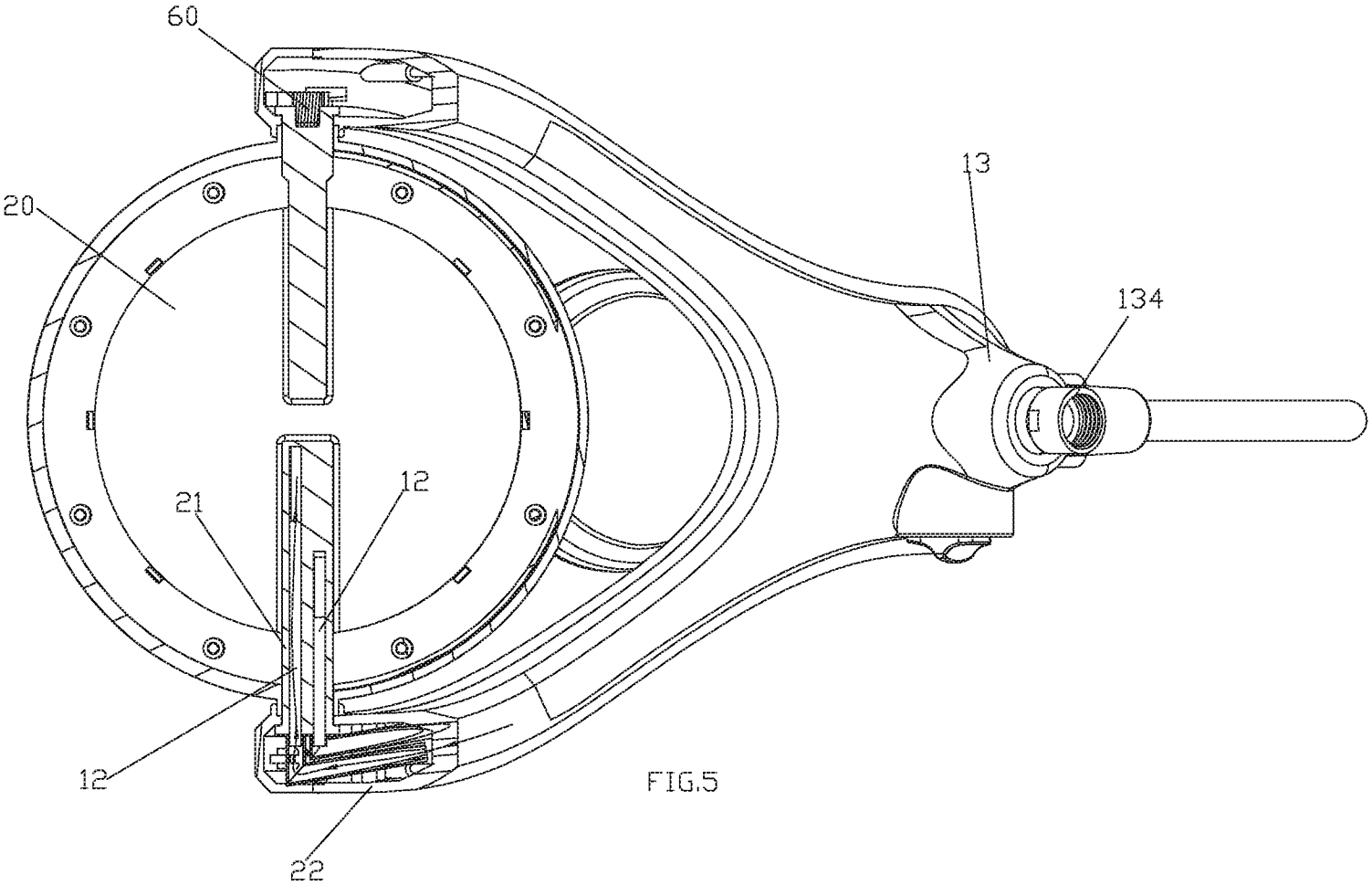
FIG. 5 illustrates a C-C cross-sectional schematic diagram of the combination showerhead of FIG. 2 under a condition of the first function.
Figure 6:
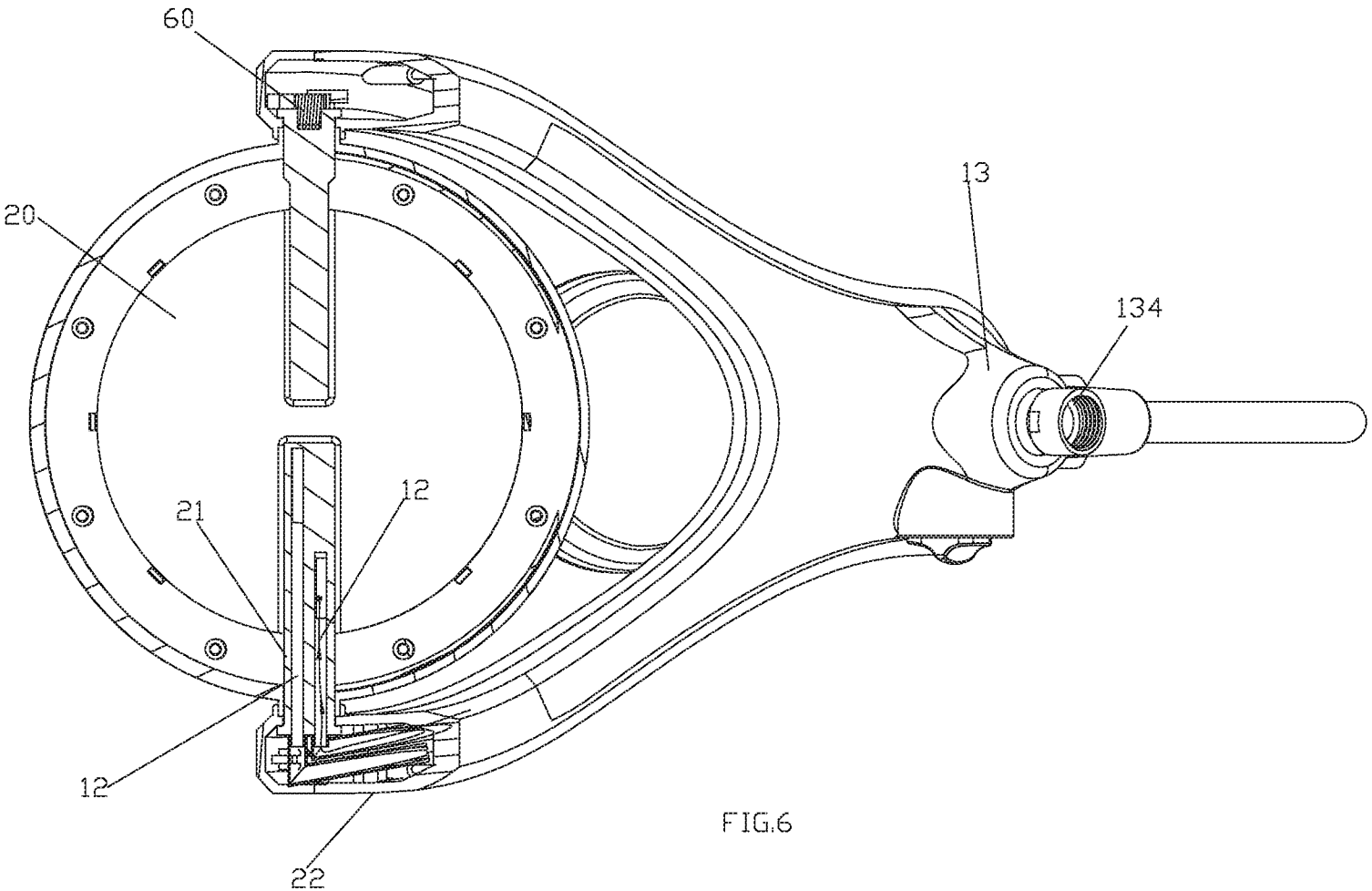
FIG. 6 illustrates a C-C cross-sectional schematic diagram of the combination showerhead of FIG. 2 under a condition of the second function.
Figure 7:
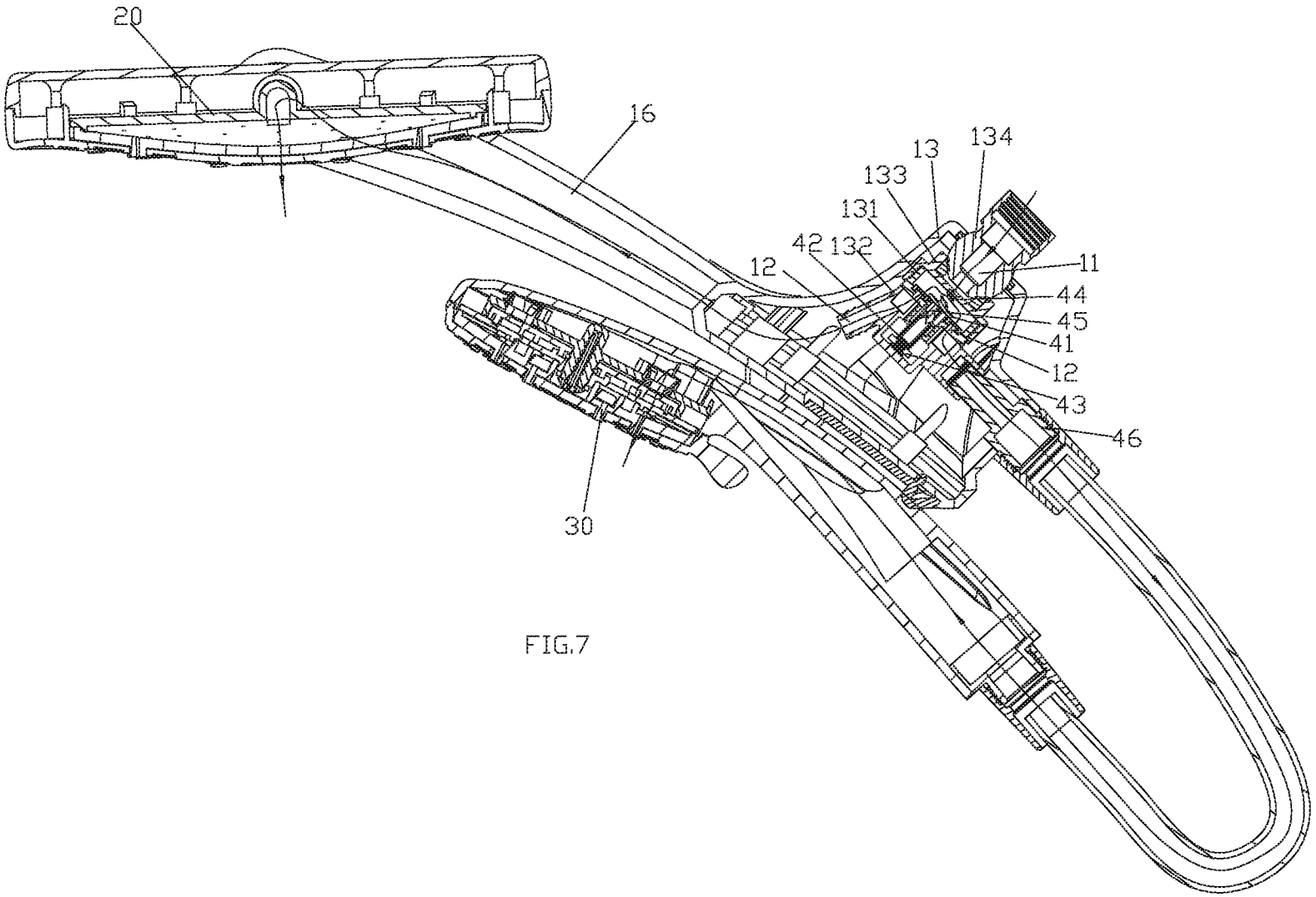
FIG. 7 illustrates a cross-sectional schematic diagram of the combination showerhead of a preferred embodiment under a condition that water flows from both of the first showerhead and second showerhead.
Figure 8:
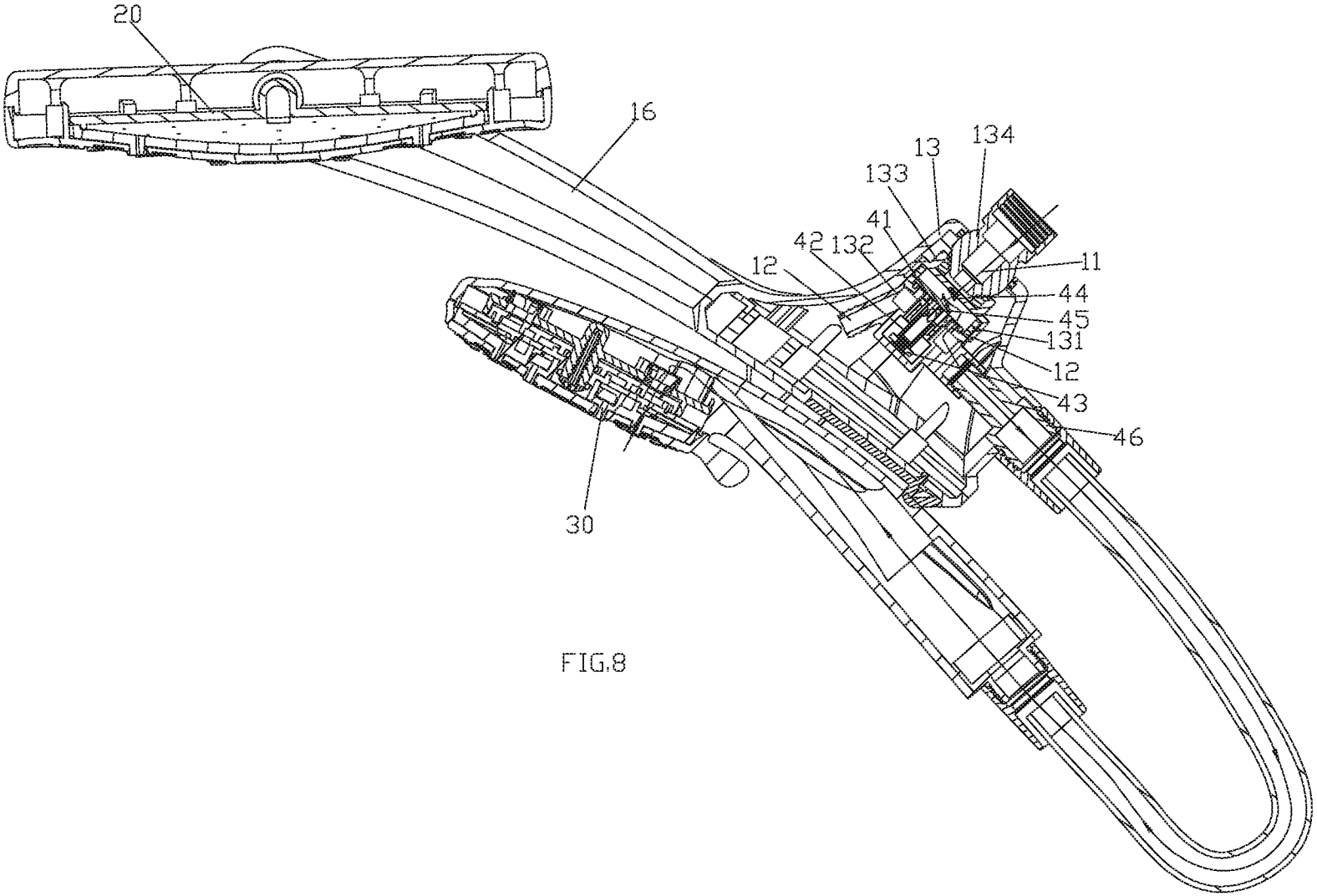
FIG. 8 illustrates a cross-sectional schematic diagram of the combination showerhead of a preferred embodiment under a condition that water flows from the second showerhead.
Figure 9:
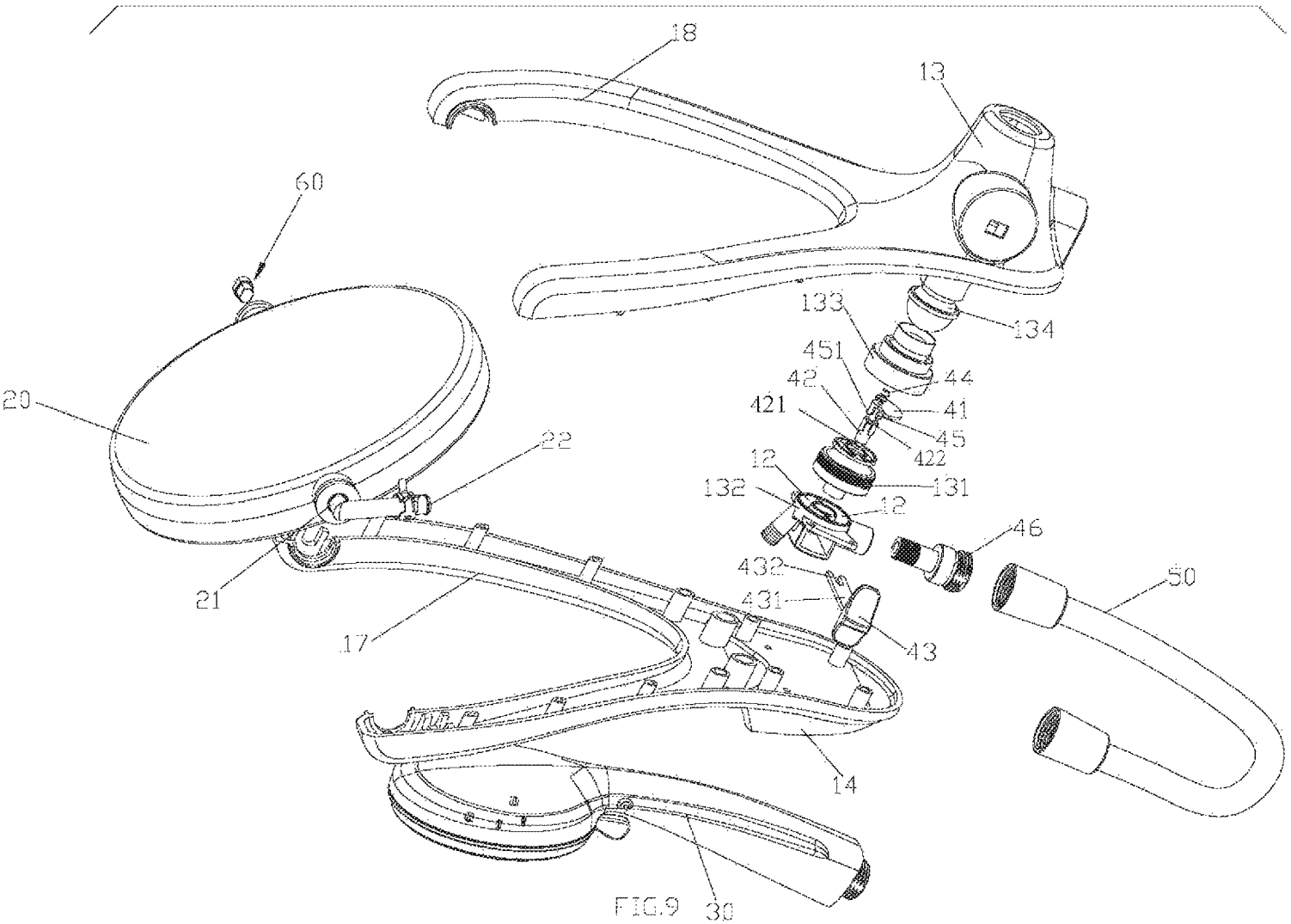
FIG. 9 illustrates an exploded perspective schematic diagram of the combination showerhead of a preferred embodiment.
Figure 11:
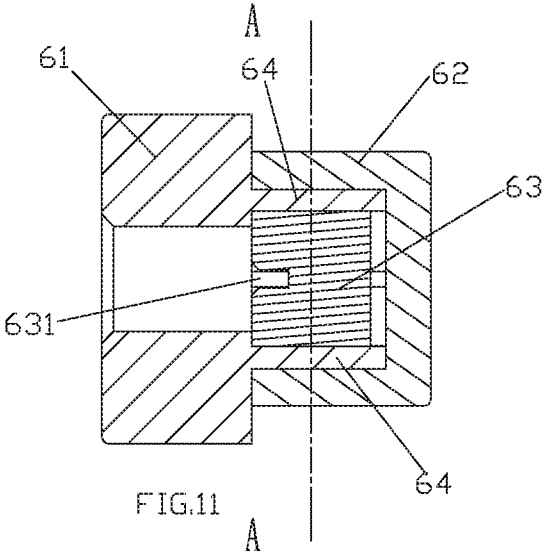
FIG. 11 illustrates a cross-sectional schematic diagram of the damping mechanism of a preferred embodiment.
Figure 10:
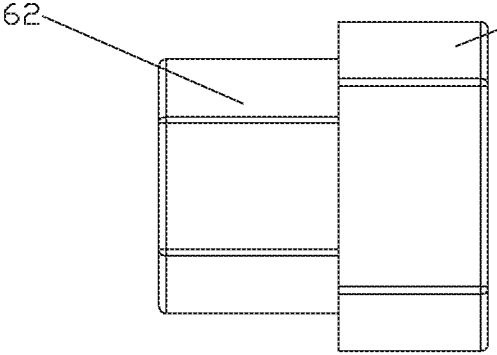
FIG. 10 illustrates a front view of the damping mechanism of a preferred embodiment.
Figure 12:
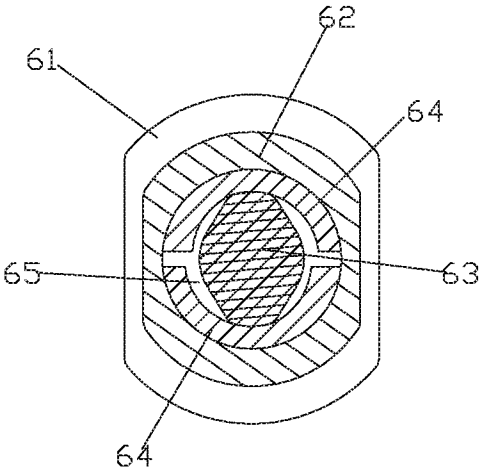
FIG. 12 illustrates an A-A cross-sectional schematic diagram of the damping mechanism of FIG. 11.

If the first showerhead 20 has more than one water spray function, the number of other diversion passages 12 could be 1, and the switching of the first showerhead and the second showerhead is realized by switching mechanism 40 while switching of water spray function on the first showerhead 20 is realized by another switching mechanism which is additional; or the number of other diversion passages 12 could be equal to the number of functions with one to one connection, and switching mechanism 40 is capable of switching the second showerhead 30 and functions of the first showerhead 20, as shown in FIG. 5 and FIG. 6.

Fixing holder 10 has a common portion 15 and two forking portions 16 extending from common portion 15, and the back of common portion 15 is convexly disposed with assembly portion 13. In this embodiment, fixing holder 10 comprises front cover 17 and back cover 18, first cover 17 and back cover 18 are fixed and connected to form the common portion and forking portions described above. A through hole is disposed on the back cover corresponding to the common portion and the edge of the through hole extends backwards to form assembly portion 13.

Switching mechanism 40 is mounted in assembly portion 13 for switching the at least two diversion passages 12 to connect with the inlet passage so as to switch the first showerhead and the second showerhead/different functions of the second showerhead. The switching could be between water flows from the first showerhead or second showerhead or any water spray function of the second showerhead, or, between water flows from the first showerhead or second showerhead or any water spray function of the second showerhead only, or of both of the first showerhead and second showerhead. Switching mechanism 40 comprises diversion plate 41, valve core 42, push button 43, elastomer 44 and shaft 45. Diversion plate 41 is connected to fixing holder 10 in a way that the diversion plate 41 is rotatable and movable along a rotation axis relative to the fixing holder, and cooperates with inlet passage 11 and diversion passages 12 so as to switch waterways by rotating a predetermined angle. For example, diversion plate 41 could have a through hole and with alignment or separation of the through hole and diversion passages to realize water connection or disconnection, or, diversion plate 41 could be fan-shaped and with complete or incomplete coverage to realize water connection or disconnection. Valve core 42 is slidably connected to the assembly portion 13 and connected to diversion plate 41 in a transmission way to drive diversion plate 41 to rotate a predetermined angle by back-and-forth sliding. Push button 43 is slidably connected to fixing holder 10 and connected to valve core 42 in a transmission way to drive valve core 42 to slide by a user's pushing. Shaft 45 is fixed on diversion plate 41. Elastomer 44 is capable of resetting valve core 42.

Specifically, the assembly portion is disposed with a slide through hole and the push button is slidably connected in the slide hole and at least part located outside the assembly portion for pushing. Push button 43 comprises fixing plate 431 and forking part 432 is formed on the end of fixing plate 431. Valve core 42 is concavely disposed with annular connecting groove 421 and forking part 432 inserts into connecting groove 421. Thereby, push button 43 can slide in parallel together with valve core 42. Valve core 42 slides along an axis of the assembly portion driven by the push button. The end of valve core 42 and shaft 45 are disposed with ratchets 422 and 451 respectively, and fixing holder 10 is disposed with ratchets also. The ratchets work in coordination to form a pencil lead mechanism. Valve core 42 drives shaft 45 together with diversion plate 41 to slide upward and rotate positively a ½ predetermined angle, and reset of valve core 42 drives shaft 45 together with diversion plate 41 to slide downward and rotate positively a ½ predetermined angle again. Elastomer 44 abuts against and between sides of the diversion plate at the back of the shaft and the assembly portion. Since the diversion plate moves upward, the elastomer is under pressure. As the push button is released, the elastomer is also released to drive the diversion plate to slide back, so as to reset the valve core. When a user pushes the push button upward, the valve core and the drive shaft 45 slide upward together with the diversion plate and the diversion plate rotates positively a ½ predetermined angle, and meanwhile the elastomer stores energy. When the push button is released, the elastomer is also released and pushes the diversion plate to slide downward and rotate positively in a ½ predetermined angle together with the shaft again, to thereby push the valve core and push button to reset.

In this embodiment, the fixing holder further comprises fixing seat 131, diversion body 132 and connecting seat 133 disposed in the assembly portion; connecting seat 133 is mounted to the supporting arm via ball joint 134. A diversion cavity is formed between connecting seat 133 and fixing seat 131 which form part of inlet passage 11. Elastomer 44, such as a spring, is configured between the diversion plate and connecting seat 133 so that diversion plate 41 is connected on the bottom of fixing seat 131 and sealed. Fixing seat 131 is disposed with at least two diversion holes to form part of diversion passages 12 respectively, and with rotating of the diversion plate, different diversion holes connecting to the diversion cavity are switched, so that switching of different diversion passages connecting to inlet passage 11 is realized. Diversion body 132 is mounted to fixing seat 131 and comprises at least two water passages which connect to diversion holes respectively and form part of diversion passages 12. Fixing seat 131 is disposed with a through-hole, and a shaft passes through the through-hole rotatably while the valve core is slidably connected in the through-hole, and ratchets of the fixing holder are disposed on the through-hole; diversion body 132 is concavely disposed with a fixing groove and the fixing plate of the push button is connected in connecting groove 421 of the valve core passing through the fixing groove.

The first showerhead 20 is rotatably connected between two forking portions 16. A hose piece 21 disposed along the rotation axis of the first showerhead 20 is connected to the first showerhead 20 and a tube 22 is disposed on the other end. The hose piece 21 and tube 22 forms a L-shape, and other diversion passages 12 are disposed along hose piece 21 and tube 22. If there is only one diversion passage 12, then hose piece 21 and tube 22 could be part of a diversion passage.

A damping mechanism 60 is disposed between forking portions 16 of fixing holder 10 and the first showerhead 20, which comprises locating holder 61, turning block 62 and cam 63. Locating holder 61 comprises a base and two dangling pieces 64 disposed separately in a circumferential direction of locating holder 61 which forms a rotary sleeve-like structure as lancing forms between two dangling pieces 64. An outer wall of the rotary sleeve-like structure is a rotating surface, while an inner wall has changing radii and forms a changing radii part, cam 63 is disposed in the rotary sleeve to match the changing radii part; turning block 62 sleeves the rotary sleeve, and friction force of dangling pieces 64 and turning block 62 changes with rotation of the cam 63 relative to the changing radii part and thereby the damping changes. In a preferred situation, the base is perforated so that one end surface of cam 63 is exposed and disposed with matching groove 631 for driving the cam to rotate by users. Locating holder 61 and turning block 62 are connected on components with relative rotation respectively, such as the forking portions and the first showerhead.

In one embodiment, the second showerhead 30 is a handle showerhead. A front lower part of common portion 15 is disposed with a connecting portion 14 for handle showerhead positioning. The connecting portion could be, but is not limited to being, a plug base or magnetic structure. The diversion passage 12 connected to the second showerhead 30 further comprises a connector 46 to connect one water passage of the diversion body, and an end opening of connector 46 forms a water outlet. The connector could pass through assembly portion 13, and the handle showerhead is connected to an outlet of a corresponding diversion passage 12 via a hose 50.

Figure 13:
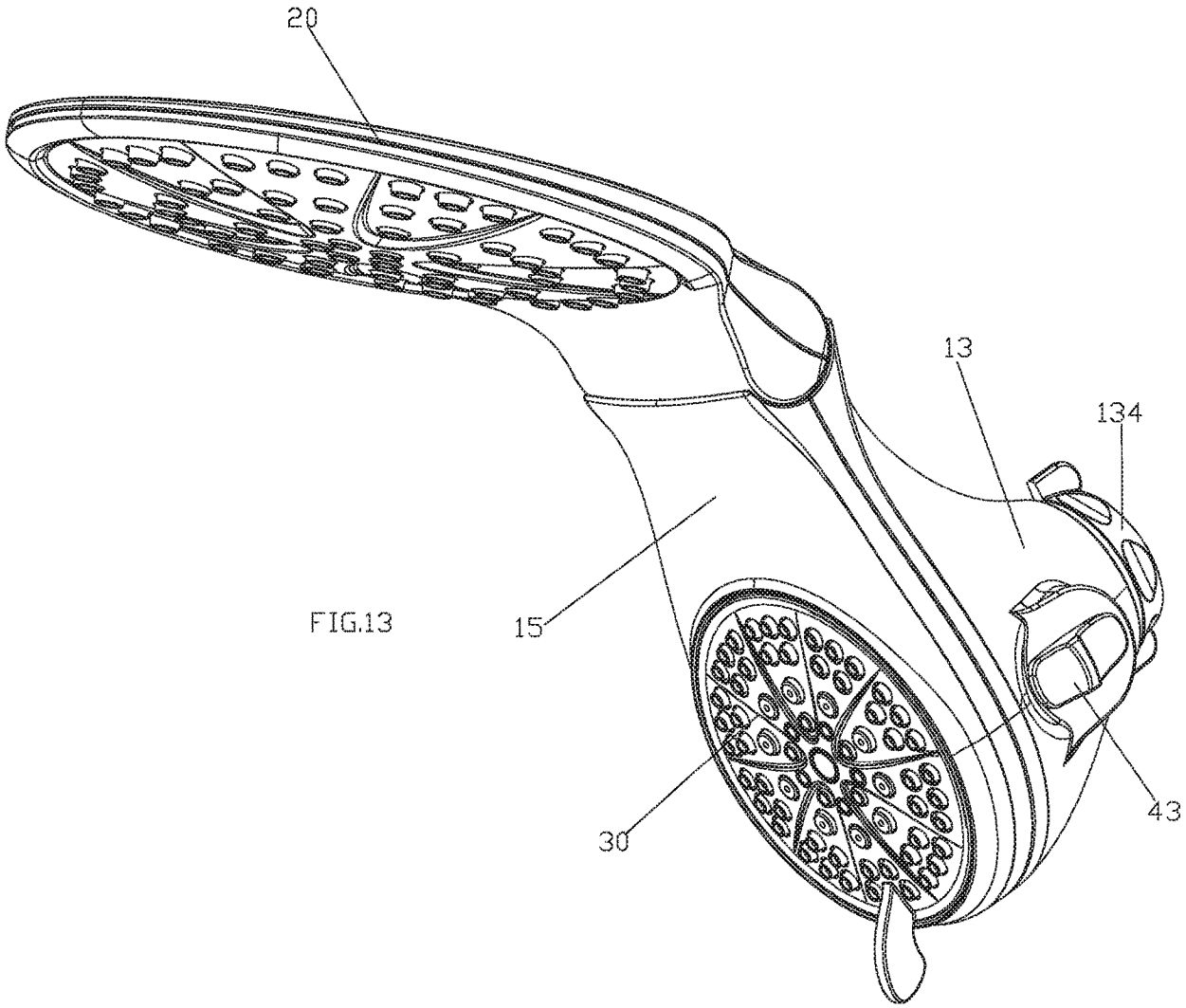
FIG. 13 illustrates a perspective schematic diagram of the combination showerhead of another preferred embodiment.
Figure 14:
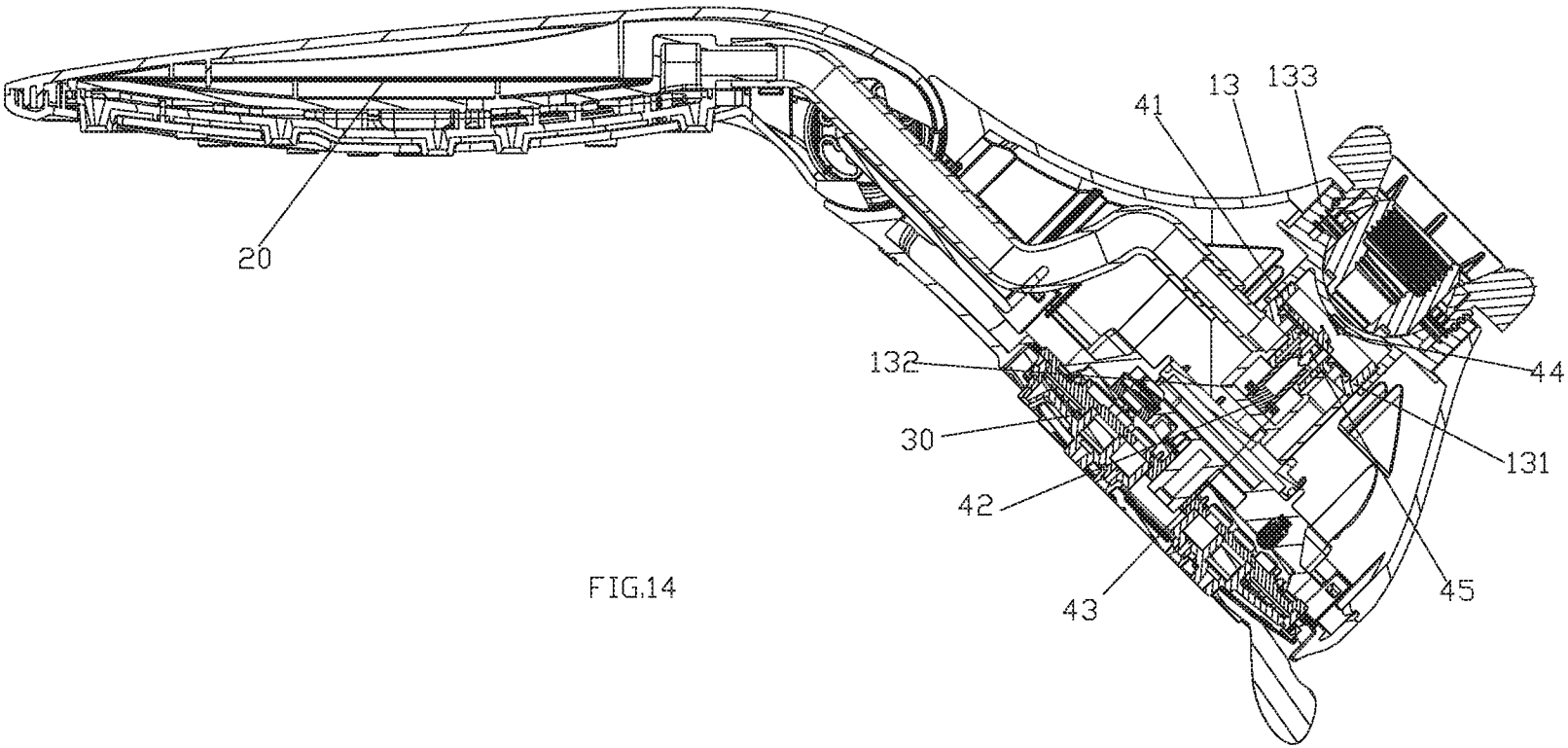
FIG. 14 illustrates a cross-sectional schematic diagram of the combination showerhead of another preferred embodiment.
Figure 15:
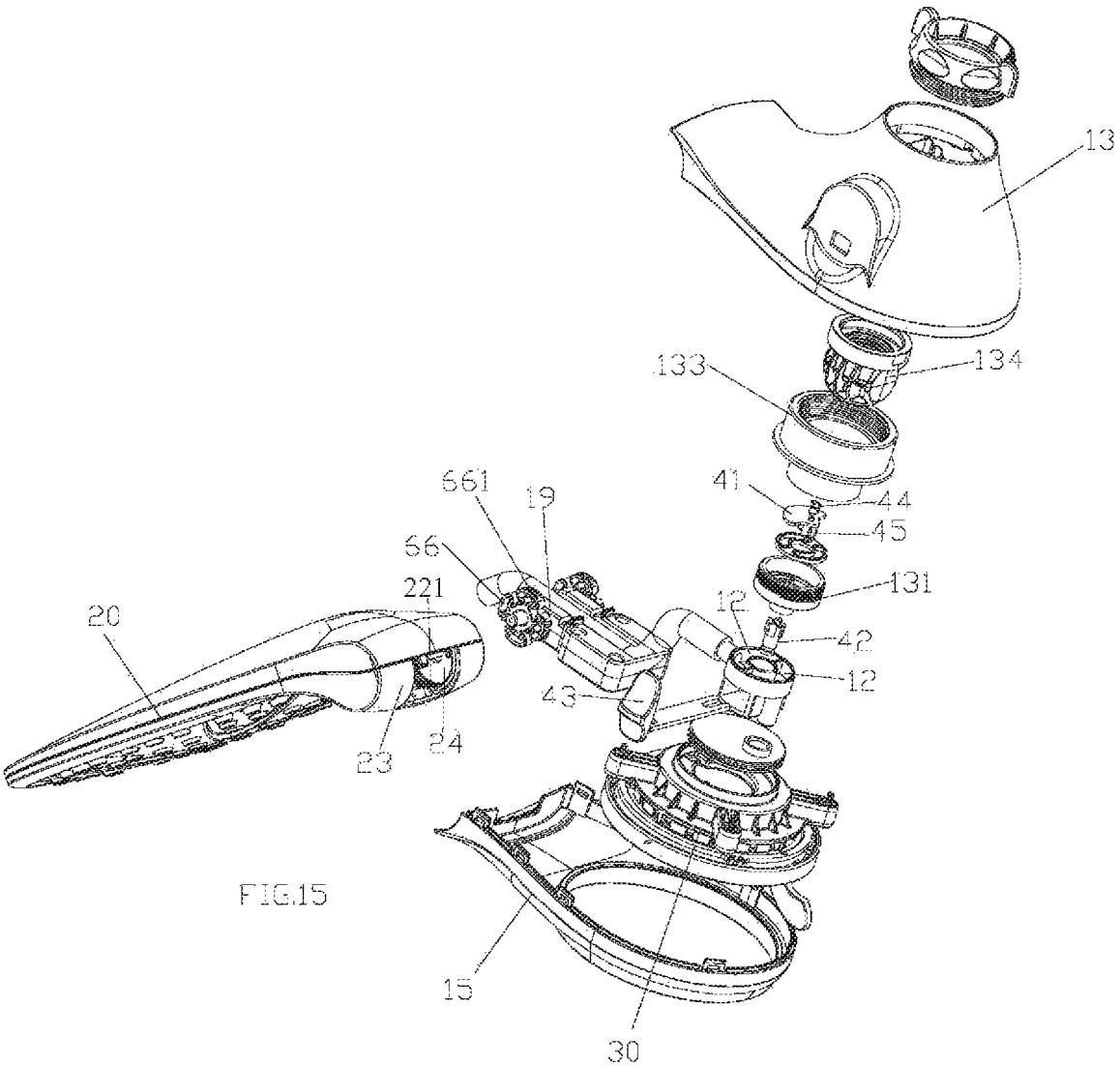
FIG. 15 illustrates an exploded perspective schematic diagram of the combination showerhead of another preferred embodiment.

In another preferred embodiment as shown in FIG. 13 to FIG. 15, the difference, compared to the above embodiment is that: the second showerhead 30 is a fixed showerhead fixed on the front lower part of the common portion of fixing holder 10, and a water passage of the diversion body connects to the fixed showerhead directly. The common portion is convexly disposed with a convex part 19, and the first showerhead is convexly disposed with two convex lugs 23. Convex part 19 is configured between the two convex lugs and the first showerhead is connected to the convex part via a pivot. The pivot is hollow for the other diversion passages passing through to connect to the first showerhead. The damping mechanism is configured between the convex part and the convex lugs, which comprises a connecting part 66 disposed on convex part 19. There could be one connecting part 66 having a cylindrical surface, or more than one connecting part 66 arrange in a circumferential direction separately with each one having a cylindrical surface. The cylindrical surface is convexly disposed with damping teeth 661. Convex lug 23 is concavely disposed with groove 24 which sleeve-connects to the connecting part. An inner wall of groove 24 is also convexly disposed with damping teeth 221 separately mating with damping teeth 661 to realize damping.

In another preferred embodiment, the diversion plate is rotatably connected to the fixing holder 10 without ratchets. Sliding of the diversion plate is limited, and with co-ordination of ratchets in the valve core and shaft, the valve core drives the shaft together with the diversion plate to rotate a predetermined angle directly.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

What is claimed is:

1. A combination showerhead with push button switching comprising:

a fixing holder mounted to a supporting arm;

a first showerhead mounted to the fixing holder;

a second showerhead; and a switching mechanism;

the fixing holder comprising an inlet passage connected to the supporting arm and at least two diversion passages;

one of the at least two diversion passages being connected to the second showerhead and another of the at least two diversion passages being connected to the first showerhead;

wherein the switching mechanism comprises:

a diversion plate movably connected to the fixing holder, and cooperating with the inlet passage and the at least two diversion passages to switch waterways by rotating a predetermined angle;

a valve core slidably connected to the fixing holder and connected to the diversion plate to drive the diversion plate to rotate the predetermined angle by back-and-forth sliding;

a push button movably connected to the fixing holder and connected to the valve core to drive the valve core to slide in response to pushing;

an elastomer to reset the valve core; and a shaft fixed to the diversion plate; and wherein an end of the valve core, an end of the shaft, and the fixing holder each have ratchets;

the diversion plate is rotatable and movable along a rotation axis relative to the fixing holder;

the elastomer is between the diversion plate and the fixing holder;

the ratchets work in co-ordination;

back-and-forth sliding of the valve core drives the shaft along with the diversion plate to cause the diversion plate to rotate the predetermined angle;

the push button is slidably connected to the fixing holder;

the push button comprises a fixing plate;

a forking part is formed on an end of the fixing plate;

the valve core comprises a connecting groove;

the forking part inserts into the connecting groove; and the push button drives the valve core to slide.

2. The combination showerhead with push button switching according to claim 1, wherein:

a back of the fixing holder has an assembly portion;

the switching mechanism is disposed inside the assembly portion; and the push button is movably connected to the assembly portion with at least part of the push button located outside the assembly portion for pushing.

3. The combination showerhead with push button switching according to claim 2, wherein:

the second showerhead has a handle;

an outlet of the at least two diversion passages connected to the second showerhead is disposed on a sidewall of the assembly portion;

the handle connects with the outlet through a flexible hose; and a front lower part of the fixing holder has a connecting portion for positioning the handle.

4. The combination showerhead with push button switching according to claim 2, wherein:

the fixing holder has a common portion;

two forking portions extend from the common portion;

the first showerhead rotatably connected between the two forking portions;

a hose piece disposed along a rotation axis of the first showerhead is connected to the first showerhead, and part of the at least two diversion passages is disposed along the hose piece.

5. The combination showerhead with push button switching according to claim 4, wherein the assembly portion is disposed on a back of the common portion.

6. The combination showerhead with push button switching according to claim 2, wherein:

the first showerhead is rotatably connected to the fixing holder; and a damping mechanism is disposed between the fixing holder and the first showerhead.

7. The combination showerhead with push button switching according to claim 6, wherein:

the damping mechanism comprises a locating holder, a turning block and a cam;

at least two pieces disposed separately in a circumferential direction on the locating holder form a rotary sleeve having at least part of an inner wall with changing radii;

the cam is disposed in the rotary sleeve to match the changing radii;

the turning block is sleeves the rotary sleeve; and friction force of the pieces and the turning block changes with rotation of the cam relative to the changing radii to change damping.

8. The combination showerhead with push button switching according to claim 2, wherein:

the fixing holder has a common portion and the first showerhead is rotatably connected to the common portion;

at least a hose piece disposed along a rotation axis of the first showerhead is connected to the first showerhead; and part of the at least two diversion passages is disposed along the hose piece.

* * * * *